United States Patent [19]

Myochin

[11] 4,295,239

[45] Oct. 20, 1981

[54] APPARATUS FOR REMOVING RESIDUAL TONER

[75] Inventor: Hisashi Myochin, Toyokawa, Japan

[73] Assignee: Minolta Camera Kabushiki Kaisha, Osaka, Japan

[21] Appl. No.: 134,578

[22] Filed: Mar. 27, 1980

[30] Foreign Application Priority Data

Mar. 30, 1979 [JP] Japan ..... 54-38662

[51] Int. Cl.[3] ..... G03G 21/00

[52] U.S. Cl. ..... 15/1.5 R; 15/256.52

[58] Field of Search ..... 15/1.5, 256.5, 256.52; 355/15; 118/652, 261; 361/225

[56] References Cited

U.S. PATENT DOCUMENTS 3,780,391 12/1973 Leenhouts ..... 15/1.5 R 4,123,154 10/1978 Fisher ..... 355/15

OTHER PUBLICATIONS

Research Disclosure Publication; p. 7, Aug. 1975.

*Primary Examiner*—Edward L. Roberts

*Attorney, Agent, or Firm*—Wenderoth, Lind & Ponack

[57] ABSTRACT

The invention disclosed relates to an apparatus for removing residual toner from a surface to be cleaned which has a rotatable cleaning brush in frictional engagement with the surface, a dusting bar disposed in abutting relation to brush bristles of the cleaning brush for dusting toner off said brush bristles, both of said dusting bar and said brush bristles being made of electrically conductive material with at least one covered with an insulating material, and means for forming an alternating electric field between the brush bristles and the dusting bar. By this, residual toner is effectively removed from the brush bristles to prevent occurrence of the filming phenomenon.

5 Claims, 7 Drawing Figures

APPARATUS FOR REMOVING RESIDUAL TONER

BACKGROUND OF THE INVENTION

The present invention relates to an apparatus for removing residual toner, and more particularly to an apparatus for removing residual toner from a surface of a photosensitive member in an image transfer type electrostatic copying machine or from a surface of a dielectric member in an electrostatic printer or a facsimile apparatus.

As well known in the art, an electrostatic latent image is formed on the surface of photosensitive member or dielectric member by use of optical means or electrical means alone or by a combination of both and the thus formed latent image is developed with toner for subsequent transfer onto a copying paper. The transfer of developed image onto the copying paper is most commonly effected by a corona charging means and thereafter, the paper is fixed to become a permanent copy. While it may be said that during the transfer of the developed image onto the copying paper, most of toner forming said developed image is transferred onto the copying paper, some toner will remain on the surface and such residual toner must be removed completely from the surface of photosensitive member or dielectric member before proceeding further with the next image forming operation.

For this purpose, the copying machine or the printer described above generally includes therein an apparatus for removing residual toner and among the various removing apparatuses hithereto proposed, a fur brush type cleaning apparatus is most commonly used as it is quite effective to remove residual toner. U.S. Pat. No. 3,917,397 discloses an embodiment of such cleaning apparatus and includes in essence a rotatable fur brush in frictional brush engagement with the surface to be cleaned for removing residual toner therefrom and a dusting bar in abutting or interrupting relation to the brush bristles for dusting off toner adhered to the brush.

On the other hand, there has been a strong demand in recent years for speeding up the image forming operation in copying machines facsimile apparatus and in electrostatic printers. To meet this demand, cleaning speed must be increased similarly to clean more area in a given unit of time. However, the increase of cleaning speed has encountered an unexpected problem in that a phenomenon generally known as the filming phenomenon has been observed on the surface to be cleaned. This filming phenomenon is the formation of a thin layer of resin of toner on the surface of the photosensitive member or dielectric member. More specifically, resin which is the major constituent of the toner gradually fuses and adheres to the cleaning surface as the cleaning operations are repeated and forms a thin layer of fused resin or toner on the surface. This occurrence of the filming phenomenon causes various harmful effects, one of which is the shortening of the life of the photosensitive member because it becomes incapable of forming a fine electrostatic latent image.

In the above-described apparatus for removing residual toner, the fur brush should be rotated at high speed in order to meet the demand for high speed image formation. However, the inventor of present application has observed the occurrence of the filming phenomenon more remarkably with an increase of the rotating speed of the fur brush. To examine the cause of the occurrence of the filming phenomenon, various experiments were conducted and attained the result that the primary reason therefor is in insufficient removal of toner adhered on the fur brush by the dusting bar. In other words, residual toner removed by the fur brush from the cleaning surface was not sufficiently dusted off by the dusting bar and this has caused remaining toner on the brush to become fused gradually to form the thin layer of resin on the surface of the photosensitive member or dielectric member. Accordingly, some measures must be taken to improve the apparatus for removing residual toner in order to avoid the occurrence of the filming phenomenon.

SUMMARY OF THE INVENTION

It is accordingly a primary object of the present to provide a novel and improved apparatus for removing residual toner free of the aforedescribed drawbacks.

Another object of the present invention is to provide an improved apparatus for removing residual toner from a surface of a photosensitive member or dielectric member without causing the filming phenomenon.

Still another object of the present invention is to provide an improved apparatus for removing residual toner which is effective for a high speed copying machine or other similar machines and which is effective in preventing occurrence of the filming phenomenon.

These and other objects of the present invention are achieved by providing an apparatus for removing residual toner which comprises at least a rotatable cleaning brush in frictional engagement with a surface to be cleaned, a dusting bar in abutting relation to the brush bristles for dusting off toner adhered to the brush in which both said brush and dusting bar are made of electrically conductive material with at least one coated or covered with an insulating material and means for forming or generating an alternating electric field between the brush bristles and the dusting bar.

For a fuller understanding of the nature and objects of the present invention, reference is made to the following detailed description taken in conjunction with the accompanying drawings.

DESCRIPTION OF THE PREFERRED EMBODIMENTS

At first, an exclusion phenomenon for flowing charged particles by means of an alternating electric field will be discussed briefly. As may be understood, toner for developing an electrostatic latent image formed on a surface of photosensitive member or dielectric member may be regarded as charged particles as they are charged to a polarity opposite to the polarity of the latent image.

Figure 1:
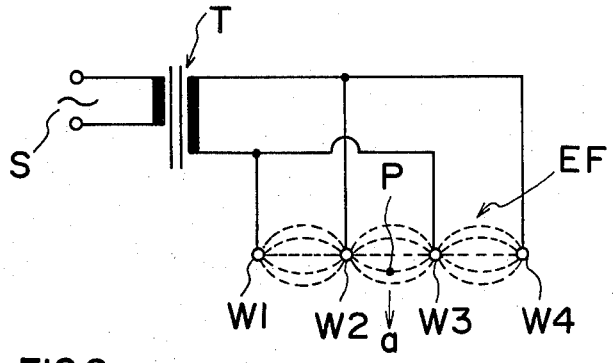
FIG.1 Prior art
FIG. 1 is a schematic drawing of an electric field curtain device which is well known in the art.

Referring to FIG. 1 which shows a schematic drawing of a known electric field curtain device, corona wires W1, W2, W3 and W4 are respectively connected to an AC power source S through an AC transformer T. Each of the wires is so connected that any wire will have a polarity opposite to the adjacent wire so that if the polarity of wires W1 and W3 is positive, then the polarities of wires W2 and W4 will be negative. These corona wires should be regarded as disposed in a vertical direction to form non-uniform electric fields EF between each of corona wires W1, W2, W3 and W4. If flowing charged particles P are to be present in said electric fields EF, then they are forced to make oscillatory movements along the electric fields and are excluded in the direction of arrow a away from the corona wires by the centrifugal force created by said oscillatory movements. This is the phenomenon generally known as the exclusion phenomenon for flowing charged particles in an alternating electric field.

The reference will now be made to FIG. 2 which shows the principle of dusting toner off brush bristles in the apparatus for removing residual toner in accordance with the present invention. In the drawing schematically showing the collision or hitting condition of a dusting bar with brush bristles, the dusting bar of a cylindrical shape is generally designated by the numeral 1 and is made of an electrically conductive material with its outer peripheral surface coated or covered with a thin layer 2 of an insulating material. More over, an electrically conductive portion of dusting bar 1 is connected to an AC power source S through an AC transformer 3. Brush bristles 4 for the cleaning brush on the other hand, are formed with electrically conductive material with their outer peripheral surfaces covered or coated with thin layers 5 of insulating material. Brush bristles 4 are electrically grounded as shown through their electrically conductive portions so as to form the alternating electric fields (drawn by dotted lines) between the dusting bar 1 and brush bristles 4. Accordingly, toner 7 and 7' collected by the cleaning brush from the surface of photosenstive member or dielectric member will be removed therefrom by the impact force between the dusting bar and brush bristles as well as by the centrifugal force created by the rotation of the fur brush. Thus removed toner 7 and 7' is then flowing in the vicinity of dusting bar 1 and is positively moved away from the brush bristles 4 in the directions of arrows b and b' by receiving the exclusion force caused in accordance with the exclusion phonomenon by the alternating electric field. Additionally, the aforedescribed exclusion force will also effectively act on toner remaining on the brush bristles 4 not removed by said impact and centrifugal forces and it is moved away from the brush bristles 4 similarly with toner 7 and 7'. Accordingly, the exclusion force described above will effectively serve to dust toner off the brush bristles in the apparatus for removing residual toner of the present invention because its efficiency for removal of toner from brush bristles is not only remarkably very high but also effective in preventing once removed toner from adhering to brush bristles again as said exclusion force acts to move the toner away from the brush bristles.

Figure 2:
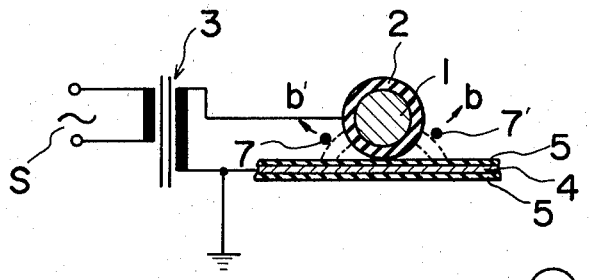
FIG. 2 is a schematic drawing showing the principle of dusting off toner adhered to the brush bristles in accordance with the present invention.

While the description directed to FIG. 2 has shown both the dusting bar 1 and brush bristles 4 to be coated with thin layers 2 and 5 of insulating material, they both need not necessarily be coated or covered with thin layers. That is, as long as either the dusting bar 1 or the brush bristle 4 is covered with a thin layer so as to prevent short-circuiting of both, the same result as above will be obtained.

Figure 3:
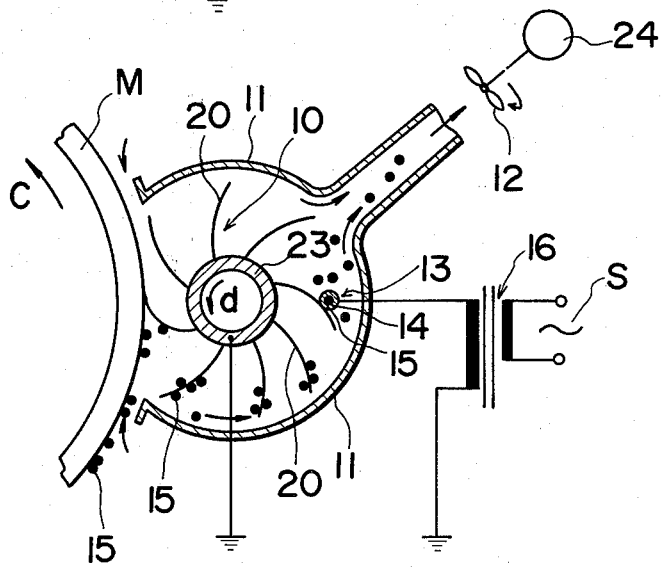
FIG. 3 is a cross-sectional view of the apparatus for removing residual toner in accordance with the present invention.

Referring now to FIG. 3 which shows an embodiment of the apparatus for removing residual toner in accordance with the present invention, a photosensitive member M in the form of a drum is rotatable in the direction of arrow C and carries residual toner 15 on its surface. For removing residual toner 15 from the surface of photosensitive member M, a cleaning brush 10 is rotatably provided in frictional engagement with the photosensitive member so as to remove residual toner by its rotation in the direction of arrow d. As brush bristles 20 for said cleaning brush 10, sandwich shaped bristles 20 shown in FIGS. 4 and 5 and each having an electrically conductive portion 21 of carbon fiber sandwiched between electrically insulating portions 22 of nylon (tradename of Belltron available from Toei Sangyo K.K.) may be used by planting them in a cylindrical support 23 of electrically conductive material. As may be seen, electrically conductive portions 21 of brush bristles 20 are electrically grounded through the cylindrical support 23.

The cleaning brush 10 is enclosed by a plurality of casing members 11 to form an opening adjacent the photosensitive member M on one side and another opening on the other side for suction purposes. The suction opening is connected to a suction fan 12 driven by a motor 24 for collecting residual toner 15 as well as for generating air flows in the directions shown.

A dusting bar 13 is disposed parallelly with respect to the rotating axis of cleaning brush 10 and is in abutting relation to the brush bristles 20. This dusting bar 13 is structurally same as that shown in FIG. 2 and has an electrically conductive portion 14 covered with a thin layer 15 of insulating material. Preferably, material selected for said thin layer should be one which is triboelectrically charged to a polarity opposite to the polarity of toner when it is frictionally contacted with the brush bristles 20. In this way, toner adhering to brush bristles will be more easily taken off. The electrically conductive portion 14 of dusting bar 13 is connected to an AC power source S through an AC transformer 16 for forming an alternating electric field between the dusting bar 13 and brush bristles 20.

With the photosensitive member M and cleaning brush 10 rotated in the directions of arrows C and d respectively, residual toner 15 remaining on the surface of photosensitive member M after transfer of a developed image onto the copying paper will be effectively removed by the brush bristles 20. Removed toner is then transported either in the directions of the arrows by the air flows generated by the suction fan 12 or in the direction of d by adhering to the brush bristles 20. Toner adhering to the brush bristles 20 is then dusted off by the dusting bar 13 in accordance with the principle described in connection with FIG. 2. More particularly, toner particles adhering to brush bristles or flowing in the vicinity of dusting bar 13 are removed therefrom by the exclusion force resulting from the alternating electric field and are transported out to the suction opening for collection by suitable collecting means.

Preferably, the voltage of the AC power source S should be in the range of about 4.5 KV to 8 KV as a voltage less than 4.5 KV is ineffective to generate sufficient exclusion force to remove toner and as a voltage greater than 8 KV will often cause electrical leakage. As for the rotating speed of the cleaning brush, it may be rotated at a speed of about 500 to 2000 revolutions per minute although it is not particularly critical.

Some experiments were conducted to observe improvements of the apparatus in accordance with the present invention. In conducting the experiments, the following conditions were established:

Voltage for AC power source: 6 KV
Frequency for AC power source: 400 Hz
Diameter of cleaning brush: 92 mm
Length of brush bristle: 36 mm
Diameter of brush bristle: 40 microns
Density of brush bristles: 9000 bristles/in$^2$
Volume resistivity of brush bristles: $10^5$ Ω·cm
Rotating speed of cleaning brush: 500 to 2000 r.p.m.

As for the photosensitive member M, developed images were repeatedly formed for transfer onto copying papers and after reproduction of 10,000 copies, the photosensitive member was removed for observation of the filming phenomenon. These experiments were repeated for a cleaning brush rotated at speed of 500 r.p.m. and 2000 r.p.m. respectively. In both cases, degrees of occurrences of the filming phenomenon were negligibly low although the degree was lower for the case in which the cleaning brush was rotated at 2000 r.p.m. This then indicates that the increase of cleaning speed becomes possible without rotating the cleaning brush at high speed. Similar experiments but with the dusting bar not connected to the AC power source were conducted to compare the degree of occurrence of the filming phenomenon. The observation resulted in a rather high degree of formation of a thin layer on the photosensitive member indicating that the apparatus in accordance with the present invention is effective in preventing occurrence of the filming phenomenon.

Figure 4:
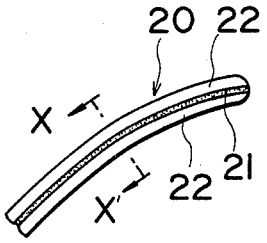
FIG. 4 is an enlarged view of a brush bristle employed in the apparatus of the present invention.
Figure 5:
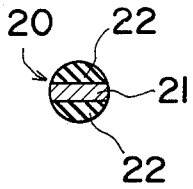
FIG. 5 is a cross-sectional of a brush bristle taken along line X—X' of FIG. 4.
Figure 6:
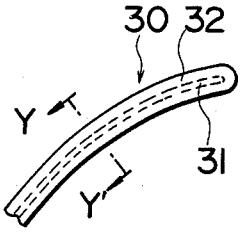
FIG. 6 is an enlarged view of another brush bristle employed in the apparatus of the present invention.
Figure 7:
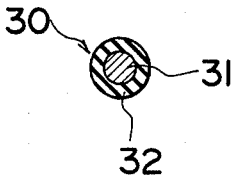
FIG. 7 is a cross-sectional view of the brush bristle taken along line Y—Y' of FIG. 6.

Although the brush bristles 20 shown in FIGS. 4 and 5, which are formed to have electrically conductive portions 21 exposed at the peripheral portions of bristles, are used in the above embodiment, brush bristles such as those shown in FIGS. 6 and 7 may be used instead as the electrically conductive material such as carbon fiber is a relatively hard material and may cause the surface of the photosensitive member or dielectric member to become damaged. In FIGS. 6 and 7, an electrically conductive portion 31 of each of brush bristles 30 is covered or coated entirely with an insulating portion 32 of relatively soft insulating material.

Although the present invention has been fully described by way of example with references to the accompany drawings, it is to be noted that various changes and modifications will be apparent to those skilled in the art. Therefore, unless otherwise such changes and modifications depart from the scope of the present invention, they should be construed as being included therein.

What is claimed is:

1. In an apparatus for removing residual toner from a surface to be cleaned which comprises a rotatable cleaning brush in frictional engagement with the surface for removing residual toner therefrom, a dusting bar disposed in abutting relation to brush bristles of said cleaning brush for dusting toner off said brush bristles, both said dusting bar and said brush bristles being made of electrically conductive material with at least one covered with an insulating material, and means for forming an alternating electric field between said brush bristles and said dusting bar.

2. In an apparatus for removing residual toner from a surface to be cleaned which comprises a rotatable cleaning brush in frictional engagement with the surface for removing residual toner therefrom, a dusting bar disposed parallelly with respect to a rotating axis of said cleaning brush and in abutting relation to brush bristles of said cleaning brush for dusting toner off said brush bristles, both said dusting bar and said brush bristles being made of electrically conductive material with at least one covered with an insulating material, and means for forming an alternating electric field between said brush bristles and said dusting bar and including an AC power source connected to either said brush bristles or said dusting bar with the other electrically grounded.

3. The apparatus as claimed in claim 2 wherein each of said brush bristles has an electrically conductive portion sandwiched between electrically insulating portions.

4. The apparatus as claimed in claim 2 wherein each of said brush bristles has an electrically conductive portion covered entirely with an insulating material.

5. The apparatus as claimed in claim 2 wherein voltage supplied for said AC power source is in the range of about 4.5 KV to 8 KV.

* * * * *